United States Patent [19]

Handler

[11] Patent Number: 4,832,521

[45] Date of Patent: May 23, 1989

[54] CLOSURE MECHANISM FOR A LOOSE-LEAF HOLDER

[76] Inventor: Anthony Handler, Mühlbachergasse 14, A-1130 Vienna, Austria

[21] Appl. No.: 248,979

[22] Filed: Sep. 26, 1988

[30] Foreign Application Priority Data

Oct. 5, 1987 [AT] Austria ..... 2524/87

[51] Int. Cl.[4] ..... B42F 13/20

[52] U.S. Cl. ..... 402/34

[58] Field of Search ..... 402/34, 80 R

[56] References Cited

U.S. PATENT DOCUMENTS

| | | | |
|---|---|---|---|
| 2,519,932 | 8/1950 | Rostoker et al. | 402/34 |
| 2,871,711 | 2/1954 | Stark | 402/34 X |
| 2,894,400 | 7/1954 | Bonn | 402/34 |

FOREIGN PATENT DOCUMENTS 816689 10/1951 Fed. Rep. of Germany .

*Primary Examiner*—Paul A. Bell
*Attorney, Agent, or Firm*—Kurt Kelman

[57] ABSTRACT

A closure mechanism for a loose-leaf holder for sheets defining holes along an edge thereof comprises a base plate, fixed prongs for receiving the holes of the sheets carried by the base plate, interconected prongs pivotal between a closed position wherein they cooperate with the fixed prongs and an open position, a connecting element carrying the pivotal prongs, and a spring held in the connecting element of the pivotal prongs and having a free end portion of the spring supported on the base plate, the spring biasing the pivotal prongs into the open position.

4 Claims, 3 Drawing Sheets

FIG.1
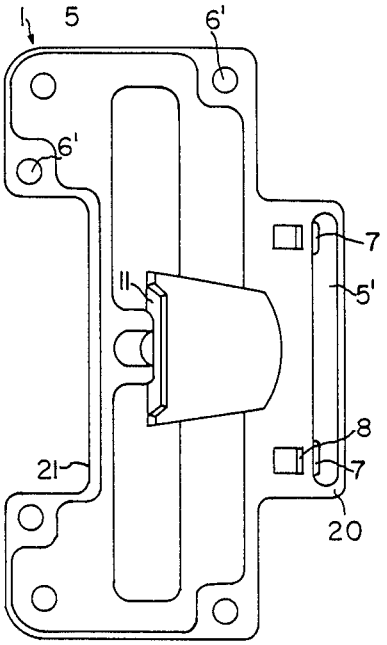
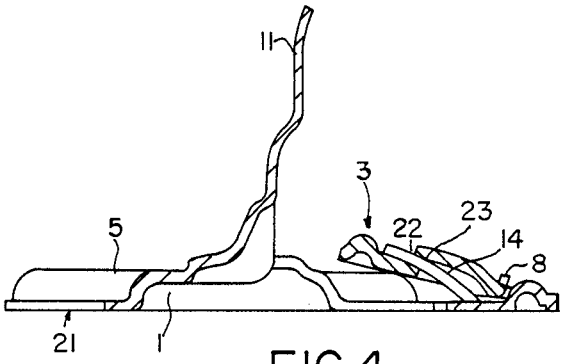
FIG.4

CLOSURE MECHANISM FOR A LOOSE-LEAF HOLDER

BACKGROUND OF THE INVENTION (1) Field of the Invention

The present invention relates to a closure mechanism for a loose-leaf holder for sheets defining holes along an edge thereof, comprising a base plate carrying fixed, straight prongs for receiving the holes of the sheets and interconnected prongs pivotal between a closed position wherein they cooperate with the fixed prongs and an open position, and a spring engaging a connecting element of the pivotal prongs, the spring biasing the pivotal prongs into the closed position.

(2) Description of the Prior Art

In conventional closure mechanisms of this type, the spring biasing the pivotal prongs against their open position is held in the base plate and presses against the connecting element of the pivotal prongs, the connecting element usually being constituted by a bridge which is integral with the pivotal prongs and has a portion protrudingly offset from the plane of the bridge. The spring is held in a slot in the base plate, and this slot is arranged in a portion of the base plate facing away from the offset portion in relation to the pivoting axis of the bridge. The spring is further supported on a bead of the base plate arranged in the range of the geometric pivoting axis of the bridge. This arrangement produces relatively poor lever ratios, causing the spring to weaken relatively rapidly and to break.

SUMMARY OF THE INVENTION

It is the primary object of this invention to overcome this disadvantage and to provide a closure mechanism of the indicated type wherein the spring is so arranged that the stroke of the spring is relatively short during the pivoting of the prongs.

In such a closure mechanism, the above and other objects are accomplished in accordance with the invention with a spring which is affixed to, or is held in, the connecting element of the pivotal prongs while a free end portion of the spring is supported on the base plate.

This arrangement enables smaller springs to be used than are conventional in such closure mechanisms, and this produces correspondingly smaller spring strokes and bending. In this arrangement, one end of the spring may simply be affixed to the connecting bridge of the pivotal prongs in the range of its protruding offset portion while a free end thereof is supported on the base plate. This enables the spring to be relatively short and correspondingly stiff, and such a spring minimizes the danger of material fatigue and breakage.

BRIEF DESCRIPTION OF THE DRAWING

The above and other objects, advantages and features of the invention will become more apparent from the following description of a now preferred embodiment thereof, taken in conjunction with the accompanying schematic drawing wherein FIG. 1 shows a base plate in top view, FIG. 4 is a section in the range of the spring.

DETAILED DESCRIPTION OF PREFERRED EMBODIMENT

Figure 2:
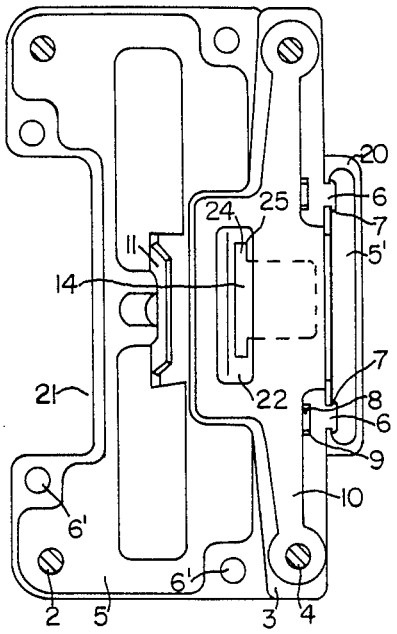
FIG. 2 is a top view of a closure mechanism of a loose-leaf holder for sheets defining holes along an edge thereof, with the base plate of FIG. 1, the prongs being shown in transverse cross section.

The drawing shows base plate 1 for a closure mechanism of a loose-leaf holder for sheets defining holes along an edge thereof. The base plate carries two fixed, straight prongs 2 for receiving the holes of the sheets (not shown) and two pivotal prongs 4 cooperating with the fixed prongs. The pivotal mounting for prongs 4 is a connecting element 3 to which prongs 4 are affixed and which is pivoted to base plate 1 so that prongs 2 and 4 cooperate upon pivoting of the connecting element into a closed position. The base plate is delimited by a first pair of parallel edges opposite each other and a second pair of parallel edges extending substantially perpendicularly to the first pair of edges, one of the edges of the first pair defining inwardly projecting recess 21 and the opposite edge of the first pair defining protruding portion 20 projecting outwardly in the same direction as the inwardly projecting recess. As shown in FIGS. 1 and 2, base plate 1 may comprise rounded corner edge portions interconnecting respective ones of the perpendicularly extending parallel edges.

As illustrated, the base plate has a stiffening rib 5 extending over most of its surface area but which leaves spaces free for bores 6' designed to receive fastening elements, such as rivets, and for pivotal connecting element 3. This connecting element is arranged in the space between stiffening rib 5 and elongated additional stiffening rib 5' extending along the edge of protruding base plate portion 20.

Figure 3:
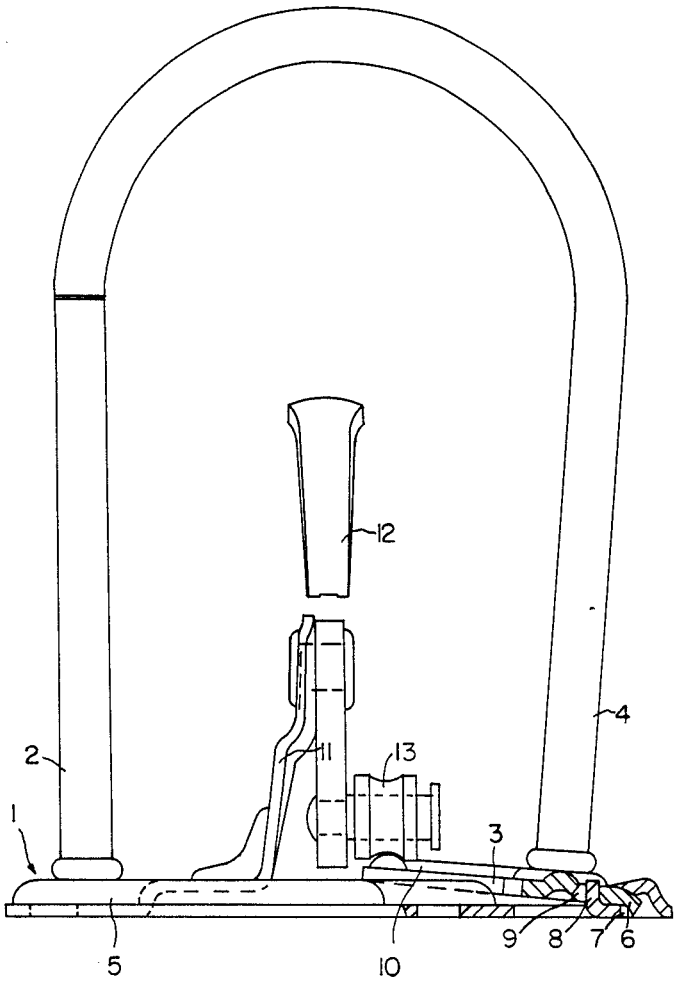
FIG. 3 is a side view of FIG. 2.

As is evident from FIG. 2, connecting element 3 has lugs 6 at its side facing stiffening rib 5' and these lugs of the connecting element or bridge are engaged in slots 7 defined in a side wall of stiffening rib 5' facing connecting bridge 3, the lugs thus subtending the web which forms this stiffening rib (see FIG. 3). Lugs 6 and slots 7 are so dimensioned that the lugs have little clearance in the slots.

To mount connecting bridge 3 on base plate 1, webs or flaps 8 are stamped out of the base plate and bent upwardly. The upwardly bent webs or flaps 8 are engaged in slots 9 of connecting bridge 3, which produces a pivotal mounting of the connecting bridge on the base plate. The connecting bridge may be disassembled from the base plate by lifting it out of upwardly bent webs or flaps 8 and simultaneously pulling lugs 6 out of slots 7 of stiffening rib 5'.

Connecting bridge 3 has a stiffening rib 10 whose web is pierced by the two pivotal prongs 4 which are affixed to the carrier plate. This serves not only to stiffen the connecting bridge but also provides space for forming rivet heads for prongs 4 at the underside of the connecting bridge for fastening the prongs thereto. Fixed prongs 2 are similarly riveted to base plate 1 in the range of stiffening rib 5.

As is conventional, holding element 11 is stamped out of base plate 1 and is bent upwardly. The holding element serves as support for the mounting of closing lever 12 carrying roller 13 which contacts upwardly projecting stiffening rib 10 of connecting bridge 3. In the closing position of the closure mechanism, lever 12 with roller 13 presses connecting bridge 3 down against the bias of leaf spring 14 held in connecting bridge 3 and having a free end support on the upper side of base plate 1.

Preferably, connecting bridge 3 is stamped out of sheet metal, provided prongs 4 are riveted thereto, and the connecting bridge has a slot 23 wherein the spring is held. This provides a very simple mounting of spring 14 and enables the spring simply to be engaged in the slot so that the assembly may be readily automated and effectuated by machines.

As shown in FIGS. 2 and 4, connecting element 3 has a stiffening rib 22 having a side wall, slot 23 is formed in the side wall of the stiffening rib and is defined between opposite end walls. Spring 14 has an end shaped like a hammer with laterally protruding portions, the hammer-shaped end of the spring resting in slot 23 and the laterally protruding end portions engaging the end walls of the slots. Stiffening rib 22 extends in the direction of elongation of the connecting bridge, and slot 23 is formed in a center portion thereof in the side wall of this stiffening rib which is closer to the pivoting axis of the connecting brdige defined by flaps 8 and slots 9 receiving the same. As can be seen in FIG. 4, one end of spring 14 is receives in slot 23. As shown in FIG. 2, this one end 24 of the spring has the shape of a head of a hammer and rests in slot 23, the two lateral projections 25 of spring end 24 engaging the lateral borders of slot 23, i.e. the side walls of elongated stiffening rib 22, thus preventing spring 14 from slipping through the slot. This arrangement securely holds the spring and, except for the hammer-shaped end of the spring which practically is not subjected to any bias and does not participate in exerting a spring force on the closure, the spring may have smooth edges, which avoids the danger of spring tears due to notches and thus enhances the operating life of the spring.

The closure mechanism, except for the spring arrangement, and the base plate for a loose-leaf holder have been disclosed in my patent applications filed on Sept. 1, 1988 and respectively entitled "CLOSURE MECHANISM FOR A LOOSE-LEAF HOLDER" and "BASE PLATES FOR A LOOSE-LEAF HOLDER".

What is claimed is:

1. A closure mechanism for a loose-leaf holder for sheets defining holes along an edge thereof, comprising (a) a base plate, (b) fixed prongs for receiving the holes of the sheets carried by the base plate, (c) interconnected prongs pivotal between a closed position wherein they cooperate with the fixed prongs and an open position, (d) a connecting element carrying the pivotal prongs, and (e) a spring held in the connecting element of the pivotal prongs and having a free end portion of the spring supported on the base plate, the spring biasing the pivotal prongs into the open position.

2. The closure mechanism of claim 1, wherein an end of the spring opposite the free end portion thereof is affixed to the connecting element.

3. The closure mechanism of claim 1, wherein the connecting element is stamped out of sheet metal, the pivotal prongs are riveted to the connecting element, and the connecting element has a slot wherein the spring is held.

4. The closure mechanism of claim 3, wherein the connecting element has a stiffening rib having a side wall, the slot is formed in the side wall of the stiffening rib and is defined between opposite end walls, and the spring has an end shaped like a hammer with laterally protruding portions, the hammer-shaped end of the spring resting in the slot and the laterally protruding end portions engaging the end walls of the slot.

* * * * *